US005940666A

United States Patent [19]

Han

[11] Patent Number: 5,940,666

[45] Date of Patent: Aug. 17, 1999

[54] LIQUID ELECTROPHOTOGRAPHIC PRINTER HAVING LIQUID CARRIER RECOVERY APPARATUS

[75] Inventor: Cheol-young Han, Suwon, Rep. of Korea

[73] Assignee: Samsung Electronics Co., Ltd., Kyungki-Do, Rep. of Korea

[21] Appl. No.: 09/097,827

[22] Filed: Jun. 16, 1998

[30] Foreign Application Priority Data

Aug. 27, 1997 [KR] Rep. of Korea ..... 97-41622

[51] Int. Cl.[6] ..... G03G 15/10

[52] U.S. Cl. ..... 399/249

[58] Field of Search ..... 399/249, 250, 399/251, 348, 360, 357, 358

[56] References Cited

U.S. PATENT DOCUMENTS 5,552,869 9/1996 Schilli et al. ..... 355/256

5,640,655 6/1997 Shoji ..... 399/249

5,737,674 4/1998 Venkatesan et al. ..... 399/250

FOREIGN PATENT DOCUMENTS 7-225516 8/1995 Japan .

*Primary Examiner*—Arthur J. Grimley
*Assistant Examiner*—Hoang Ngo
*Attorney, Agent, or Firm*—Sughrue, Mion, Zinn, Macpeak & Seas, PLLC

[57] ABSTRACT

A liquid electrophotographic printer includes a photoreceptor belt supported by and traveling around a plurality of rollers, a development device for supplying a developer liquid to the photoreceptor belt, and a drying roller having a cylindrical roller body having a hollow and through holes leading to the hollow, a rotation member rotatably installed on the outer surface of the roller body and having a plurality of mesh-like inlet holes, and an absorbing member coupled to the outer surface of the rotation member, for absorbing the liquid carrier in contact with the photoreceptor belt.

5 Claims, 3 Drawing Sheets

LIQUID ELECTROPHOTOGRAPHIC PRINTER HAVING LIQUID CARRIER RECOVERY APPARATUS

BACKGROUND OF THE INVENTION

1. Field of the Invention

The present invention relates to a liquid electrophotographic printer, and more particularly, to a liquid electrophotographic printer having a recovery unit for recovering a liquid carrier from a drying roller in contact with a photoreceptor.

2. Description of the Related Art

In general, in a liquid electrophotographic printer such as a laser printer, an electrostatic latent image is formed on a photoreceptor such as a photoreceptor drum or a photoreceptor belt, developed using a toner having a predetermined color, and transferred to a sheet of paper, thereby obtaining a desired image.

The laser printer is largely classified into a liquid type and a dry type according to the toner used therein. The liquid-type laser printer employs a developer liquid containing a toner mixed with a volatile liquid carrier. The liquid-type laser printer exhibits better printing quality than the dry-type laser printer. Also, the liquid-type printer can prevent problems associated with using the hazardous toner powder. Thus, the liquid-type laser printer is increasingly used.

Referring to FIG. 1, a conventional liquid electrophotographic printer 100 includes a circulating photoreceptor belt 110 supported by a roller 112, a development station 120 installed directly under the photoreceptor belt 110, and a drying station 130 for recovering the liquid carrier supplied to the photoreceptor belt 110.

A developer liquid composed of toner having a predetermined color and liquid carrier is contained in the development station 120. The development station 120 also includes a developing roller 121, a cleaning roller 122 and squeegee rollers 123 and 124.

The developing roller 121 applies the developer liquid supplied from a developer liquid supplier 125 to the electrostatic latent image formed on the photoreceptor belt 110 by a laser scanning unit 111. The cleaning roller 122 removes the developer liquid remaining on the developing roller 121.

The squeegee rollers 123 and 124 remove the excess developer liquid from the photoreceptor belt 110 after the developer liquid is utilized for developing the electrostatic latent image. The removed developer liquid is induced by blades 126 and 127 and withdrawn into the development station 120.

Subsequently, the liquid carrier contained in the developer liquid sticking to the photoreceptor belt 110 is removed by the drying station 130. The drying station 130 includes a drying roller 131 pressed by the roller 112 and rotating in contact with the photoreceptor belt 110, a plurality of heating rollers 132 rotating in contact with the drying roller 131, and a collecting case 133.

An oleophilic absorption layer 131*a* provided on the surface of the drying roller 131 absorbs the liquid carrier remaining on the photoreceptor belt 110.

A halogen lamp 134 is provided within each of the heating rollers 132. The surface of the drying roller 131 is heated using the heat generated from the halogen lamp 134, thereby evaporating the liquid carrier absorbed into the absorption layer 131*a*. The evaporated liquid carrier is collected in the collecting case 133 and liquefied in a liquefaction device (not shown) for recycling. Finally, only the toner corresponding to the development image remains on the surface of the photoreceptor 110.

However, since the drying station 130 evaporates the liquid carrier remaining on the surface of the photoreceptor 110 to then recover the same in a gaseous state, a large amount of liquid carrier cannot be sufficiently removed. Particularly, excess developer liquid is not sufficiently removed from the squeegee rollers 123 and 124 of the development station 120, thereby further degrading the recovery efficiency of the liquid carrier.

SUMMARY OF THE INVENTION

To solve the above problems, it is an objective of the present invention to provide a liquid electrophotographic printer having a drying roller which can withdraw a liquid carrier from a photoreceptor belt in both gaseous and liquid states.

Accordingly, to achieve the above objective, there is provided a liquid electrophotographic printer comprising: a photoreceptor belt supported by and traveling around a plurality of rollers; a development device for supplying a developer liquid to the photoreceptor belt; and a drying roller having a cylindrical roller body having a hollow and through holes leading to the hollow, a rotation member rotatably installed on the outer surface of the roller body and having a plurality of mesh-like inlet holes, and an absorbing member, coupled to the outer surface of the rotation member, for absorbing the liquid carrier in contact with the photoreceptor belt.

Also, the liquid electrophotographic printer further comprises: a supporting tube to which the roller body is fixed and having a cavity connected to the hollow of the roller body.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
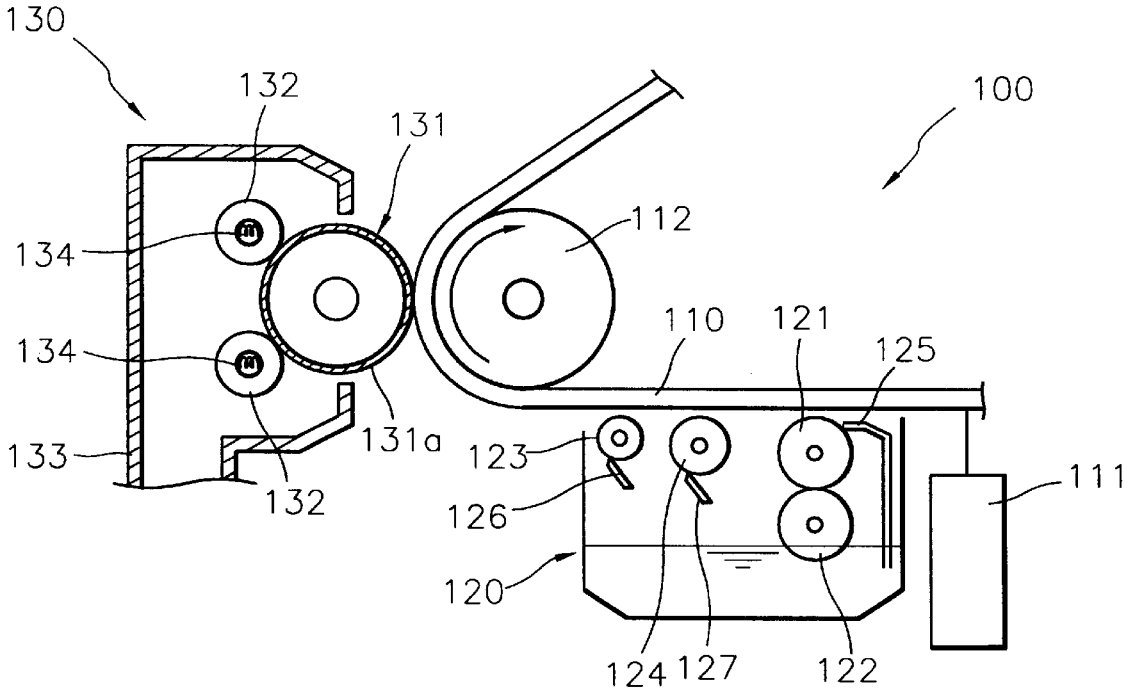
FIG. 1 (PRIOR ART)
FIG. 1 is a schematic diagram of a conventional liquid electrophotographic printer.
Figure 2:
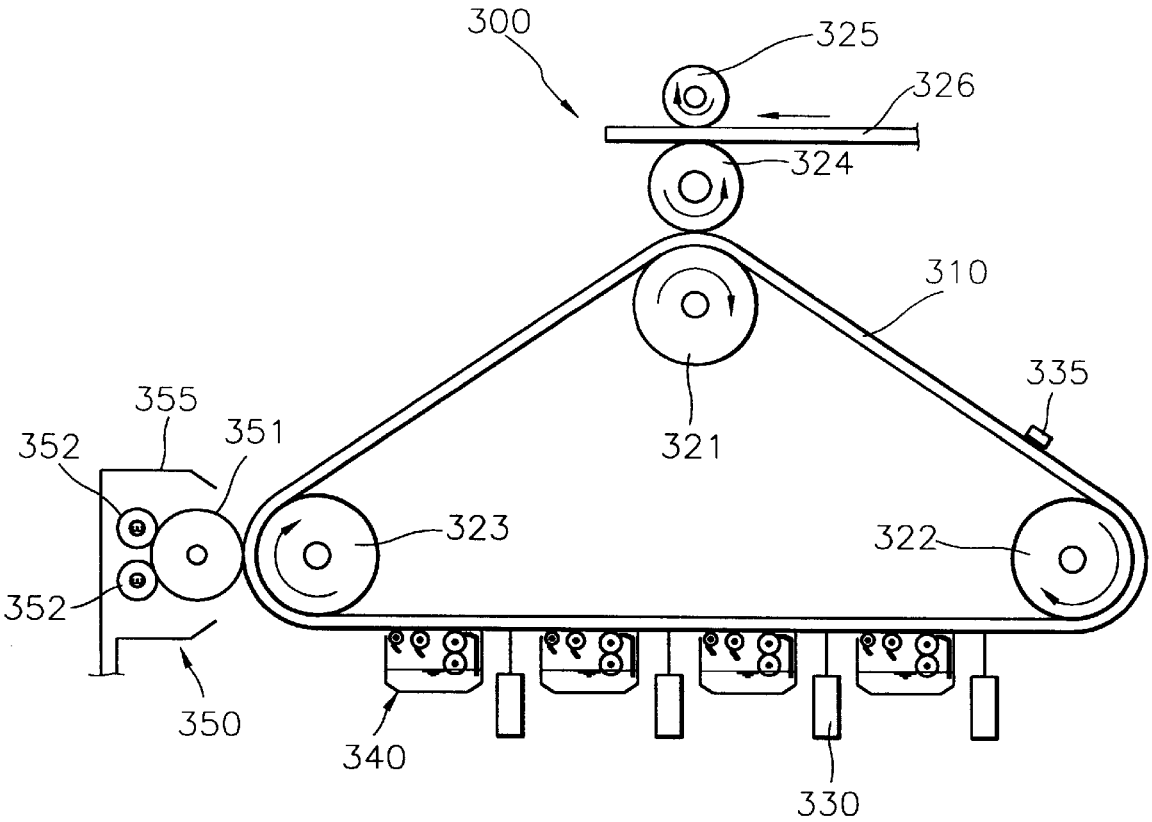
FIG. 2 is a schematic diagram of a liquid electrophotographic printer according to the present invention.

Referring to FIG. 2, a liquid laser printer 300 according to an embodiment of the present invention includes a backup roller 321, a steering roller 322 and a driving roller 323, for supporting a photoreceptor belt 310. The driving roller 323 drives the photoreceptor belt 310, and the steering roller 322 adjusts the tension of the photoreceptor belt 310 to prevent deviation of the photoreceptor belt 310 from its traveling track.

The surface of the photoreceptor belt 310 is uniformly charged by a main charger 335. On the downstream side of the photoreceptor belt 310 are installed a laser scanning unit (LSU) 330 for irradiating a laser beam onto the photoreceptor belt 310 according to image signals to form an electrostatic latent image, and a development device 340 for developing the electrostatic latent image by supplying the same with the developer liquid containing a toner having a predetermined color mixed with a liquid carrier. In the case of a color printer, there are provided a plurality of LSUs 330 for printing various colors, and a plurality of development devices 340 containing developer liquids of different colors.

The photoreceptor belt 310 to which the developer liquid is supplied by the development devices 340 is dried by a drying device 350 installed on the downstream side of the development devices 340, so that the liquid carrier contained in the developer liquid is removed and only the toner corresponding to the electrostatic latent image remains.

The development image developed by the toner is transferred to a sheet of paper 326 fed between a transfer roller 324 and a pressing roller 325 via the transfer roller 324.

In the present invention, the drying device 350 includes a drying roller 351, a heating roller 352 and a collecting case 355. The drying roller 351 is pressed against the driving roller 323 and contacts the photoreceptor belt 310 to then absorb the liquid carrier therefrom.

Figure 3:
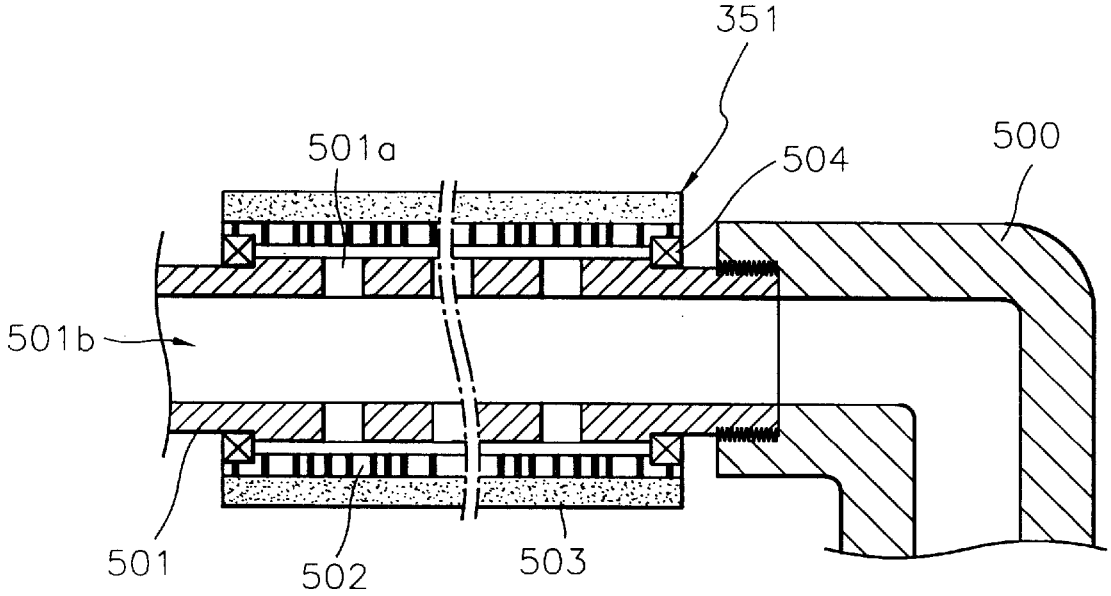
FIG. 3 is a schematic cross-sectional view of a drying roller of the liquid electrophotographic printer shown in FIG. 2.

As shown in FIG. 3, the drying roller 351 includes a cylindrical roller body 501, a rotation member 502 rotatably installed on the outer surface of the roller body 501, and an absorbing member 503 coupled to the outer surface of the rotation member 502.

Figure 4:
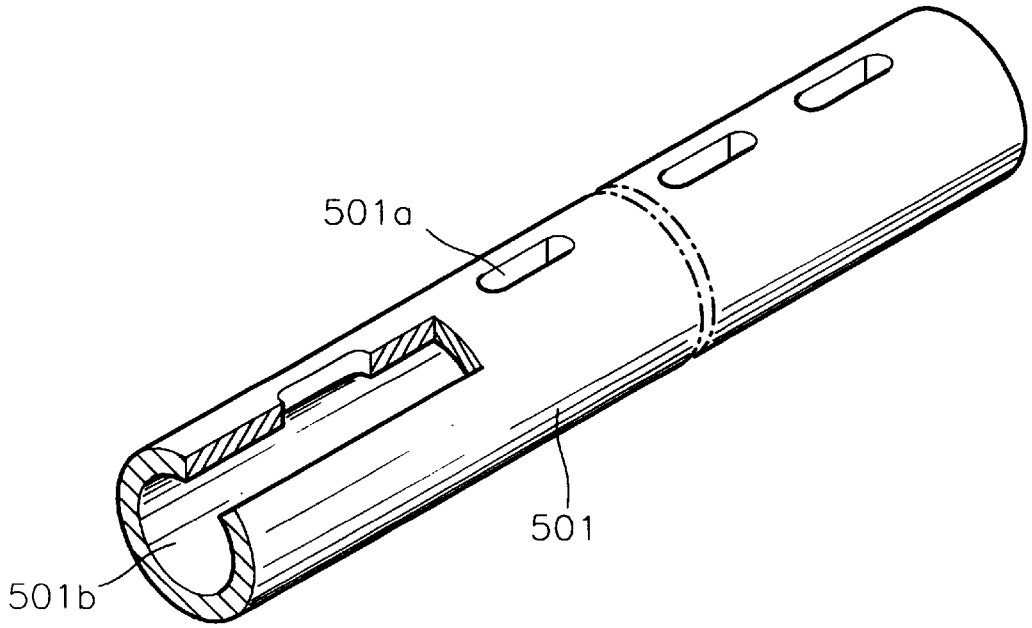
FIG. 4 is a schematic perspective view of a roller body of the drying roller shown in FIG. 3.

As shown in FIG. 4, the roller body 501 has a hollow 501*b* and is fixed to a supporting tube 500 so that the hollow 501*b* leads to a hollow of the supporting tube 500. Also, a through hole 501*a* leading to the hollow 501*b* is formed in the roller body 501. The rotation member 502 is rotatably installed on the outer surface of the roller body 501 by bearings 504 (see FIG. 3), and is an oleophilic absorbing member having a plurality of inlet holes such as a mesh.

The photoreceptor belt 310 on which the electrostatic latent image is formed receives the developer liquid by the development devices 340 (see FIG. 2) and then contacts the drying roller 351. Here, the absorbing member 503 of the drying roller 351 presses against the photoreceptor belt 310 and absorbs the liquid carrier contained in the developer liquid.

The liquid carrier absorbed by the absorbing member 503 passes through the inlet holes of the rotation member 502 and is induced into the hollow 501*b* via the through hole 501*a* of the roller body 501. The liquid carrier collected in the hollow 501*b* is recovered by the supporting tube 500 by driving a pump (not shown).

Also, the liquid carrier remaining on the absorbing member 503 is evaporated by the heating roller 352 rotating in contact with the drying roller 351, to thereby be removed from the drying roller, and the evaporated carrier is recovered in the collecting case 355.

According to the present invention, the excess liquid carrier applied to the drying roller 351 can be recovered after evaporating the liquid carrier. Otherwise, the carrier can be directly recovered in a liquid state. Therefore, the efficiency in recovery of the liquid carrier can be improved, contamination of the printer can be prevented, and printing quality can be improved.

What is claimed is:

1. A liquid electrophotographic printer comprising:

a photoreceptor belt supported by and traveling around a plurality of rollers;

a development device for supplying a developer liquid to the photoreceptor belt; and a drying roller comprising:

a cylindrical roller body having a hollow and through holes leading to the hollow, a rotation member rotatably installed on the outer surface of the roller body and having a plurality of mesh-like inlet holes, an absorbing member coupled to the outer surface of the rotation member, for absorbing the liquid carrier in contact with the photoreceptor belt; and a supporting tube to which the roller body is fixed and having a hollow communicating with the hollow of the roller body; and wherein the rotation member is coupled to the roller body by bearings.

2. The liquid electrophotographic printer according to claim 1, further comprising:

a heating roller for evaporating the liquid carrier in contact with the drying roller; and a collecting case for recovering the evaporated liquid carrier.

3. A liquid electrophotographic printer comprising:

a photoreceptor belt supported by and traveling around a plurality of rollers;

a development device for supplying a developer liquid to the photoreceptor belt; and a drying roller comprising:

a roller body having a hollow and through holes leading to the hollow, a rotation member rotatably installed on the outer surface of the roller body and having a plurality of inlet holes, an absorbing member coupled to the outer surface of the rotation member, for absorbing the liquid carrier in contact with the photoreceptor belt; and a supporting tube to which the roller body is fixed and having a hollow communicating with the hollow of the roller body; and wherein the rotation member is coupled to the roller body by bearings.

4. The liquid electrophotographic printer according to claim 1, wherein said absorbing member is pressed against the photoreceptor belt by said cylindrical roller body.

5. The liquid electrophotographic printer according to claim 3, wherein said absorbing member is pressed against the photoreceptor belt by said roller body.

* * * * *